United States Patent [19]

Yeh

[11] 4,434,818

[45] Mar. 6, 1984

[54] WIRE FEEDING AND WIRE FORMING DEVICE FOR PAPER CLIP MAKING MACHINE

[75] Inventor: Jaw Shung Yeh, Taipei, Taiwan

[73] Assignee: Shu-Chang Chen, Taipei Hsieng, Taiwan

[21] Appl. No.: 412,181

[22] Filed: Aug. 27, 1982

[51] Int. Cl.[3] ..... B21F 45/16

[52] U.S. Cl. ..... 140/82; 72/187; 72/191; 198/480; 198/690

[58] Field of Search ..... 140/82, 105, 71 R; 72/191, 187, 452; 198/480, 481, 482, 690, 607, 688, 698, 699

[56] References Cited

U.S. PATENT DOCUMENTS

| | | | |
|---|---|---|---|
| 2,646,277 | 7/1953 | Southwick | 140/105 |
| 2,873,843 | 2/1959 | Wilson | 198/690 |
| 2,996,788 | 8/1961 | Austin et al. | 198/481 |
| 3,941,242 | 3/1976 | Braden | 198/480 |
| 4,266,655 | 5/1981 | Payne | 198/481 |

FOREIGN PATENT DOCUMENTS 92198 4/1923 Austria .

*Primary Examiner*—Francis S. Husar
*Assistant Examiner*—Linda McLaughlin
*Attorney, Agent, or Firm*—Kirschstein, Kirschstein, Ottinger & Cobrin

[57] ABSTRACT

An apparatus used for the paper clip making machine downstream of the cutting machine comprises, a set of conveyors including continuous belt continuous chains, transferring wheels for advancing the cut wires, pieces of magnet properly located on the conveyors for attracting and arraying the cut wire in a proper orientation, three annular members spaced apart and mounted for rotation on the same axis, each of the annular members having a plurality of forming die member on the rim thereof for receiving and engaging cut wires, three segmented ring members of different lengths provided along the circumferences of corresponding annular members, ramming means provided at two sides of the annular member assembly adapted to exert bending forces on cut wires in the direction parallel to the axis of the annular member, the die members intermittently rising from the rim of the annular member to cooperate with the ramming means to bend the cut wires about the segmented ring members.

5 Claims, 12 Drawing Figures

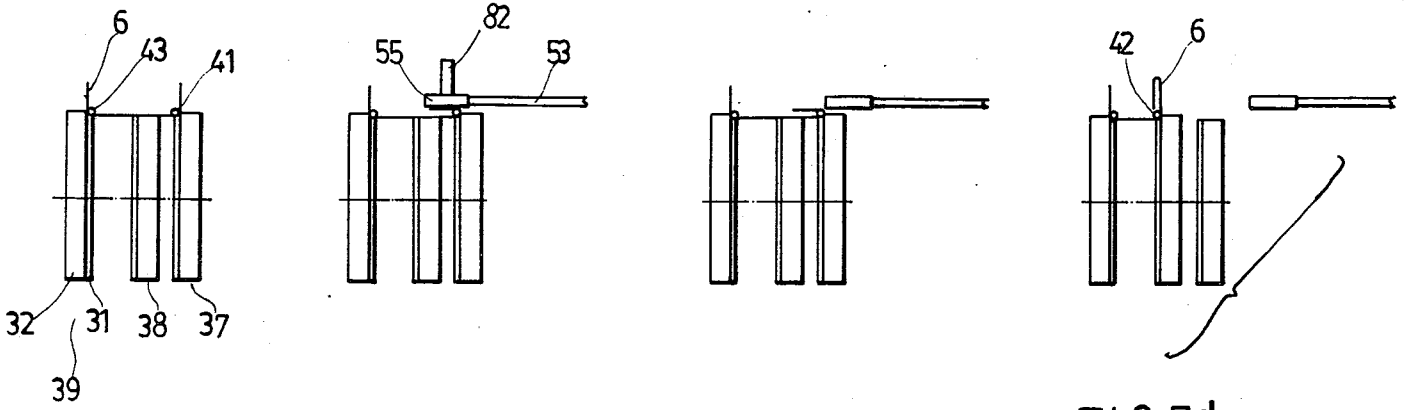
FIG.7a
FIG.7b
FIG.7c
FIG.7d
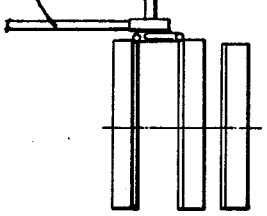
FIG.7f
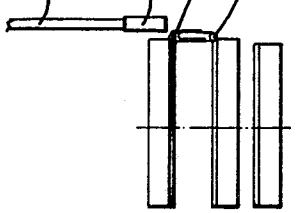
FIG.7g
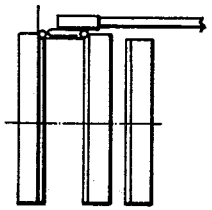
FIG.7e

WIRE FEEDING AND WIRE FORMING DEVICE FOR PAPER CLIP MAKING MACHINE

BACKGROUND OF THE INVENTION

This invention relates to a paper clip making machine, particularly to wire feeding and forming device for paper clip making machine.

Paper clip making machines proposed today generally include tubular die member and reciprocating means to form the wires into paper clips by pulling pushing and bending. The wire forming operation of such machines produce only one piece at one cycle. Additionally, during processing, a tension will be produced in the wire rod, causing a difficulty of controlling the dimension of the paper clip formed. In many cases, there includes many defective pieces in the final products.

SUMMARY OF THE INVENTION

A construction according to the present invention includes, a wire feeding device which comprises, continuous belt means for receiving and advancing cut wires provided with magnet elements at regular intervals for attracting and arraying cut wires, continuous chain means provided downstream of the belt means with one end of the conveying path thereof overlapping the belt means, the chain means including regularly spaced apart catching projections thereon for taking the cut wires from the belt means, first wheel means overlappingly provided downstream of the chain means and having regularly spaced catching teeth for taking cut wires from the chain means, and grooves at the same spaced apart intervals as the catching teeth for receiving the cut wires, idler wheel means cooperative with the chain means to provide an elevation in the chain path near the first wheel means so that the cut wires on the chain means coincide and are caught by the catching teeth, the catching projections leaving the cut wires with the first grooves of the first wheel means after passing over the idler wheel, second wheel means in contact with the first wheel means, the second wheel means having second grooves at the same spaced apart intervals as the first grooves and a second magnet element in each second groove, the first and second grooves coinciding each other and the second magnet elements attracting the cut wires from the first wheel at the points of coinciding, the second wheel means finally delivering the cut wires with a proper orientation of the cut wires corresponding to the cut wires receiving stations of the wire forming device.

Another aspect of the invention includes, a wire forming device which comprises, three annular members spaced apart and mounted for rotation on the same axis, each of the annular members having a plurality of forming die member on the rim thereof for receiving and engaging cut wires, each of the die members of each of the annular members being axially aligned with each of the die members of other annular members for simultaneously engaging a cut wire, three segmented ring members of different lengths provided, in a fixed position relative the annular member, along the circumferences of corresonding annular members wit clearances provided therebetween similar to the diameter of the cut wire, ramming means provided at two sides of the annular member assembly adapted to exert bending forces on cut wires in the direction parallel to the axis of the annular member, the die members intermittently rising from the rim of the annular member to cooperate with the ramming means to bend the cut wires about the segmented ring members.

According to further aspect of the invention, each of the die members has a shank portion adapted to be inserted into the rim of each of the annular members, each annular member including first cam means therein for engaging with the end of the shank portion to impart an intermittently raising movement.

According to still further aspect of the invention, the ramming means includes two rotary members each of which is provided at each side of the annular member assembly and has a sets of elongated elements annularly and movably mounted thereon, the rotary members being in coaxial with and rotatable at the same speed as the annular members, second cam means engaging one ends of the elongated element, spring means for biassing the elongated elements against the cam means, cooperating with the second cam means to provide reciprocating movements of the elongated elements, other ends of the elongated elements intermittantly extending over the die members for bending the cut wires.

An object of the invention is to provide an improved high speed paper clip making machine which can produce a number of clips at one cycle.

Another object of the invention is to provide a paper clip making machine in which the wire bending operation will not produce tension and twist in the wire rod.

These and other objects, features and advantages of the present invention will be more apparent in the following description of a preferred embodiment with reference to the accompanying drawing, in which:

FIGS. *6a* and *6b* show side views of the die member mounted on the reciprocating bar; and FIGS. *7a* through *7g* illustrate the wire bending operations of the device according to the invention.

DETAILED DESCRIPTION OF THE PREFERRED EMBODIMENT

Figure 1:
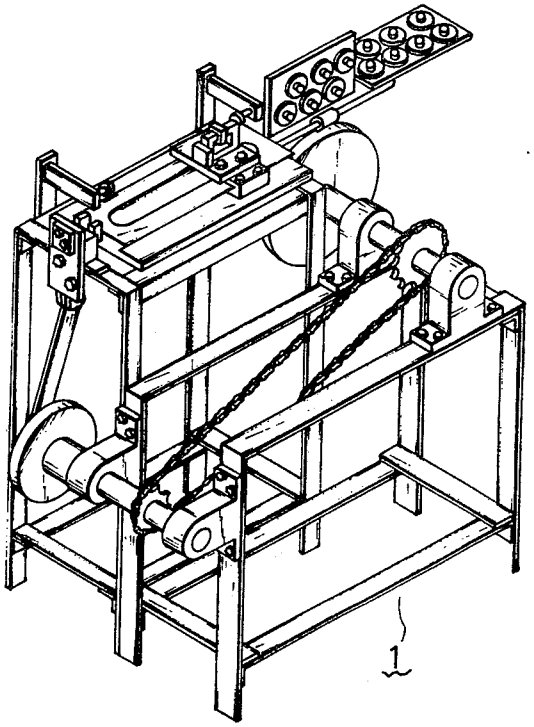
FIG. 1 is a perspective view of a wire cutting unit.
Figure 2:
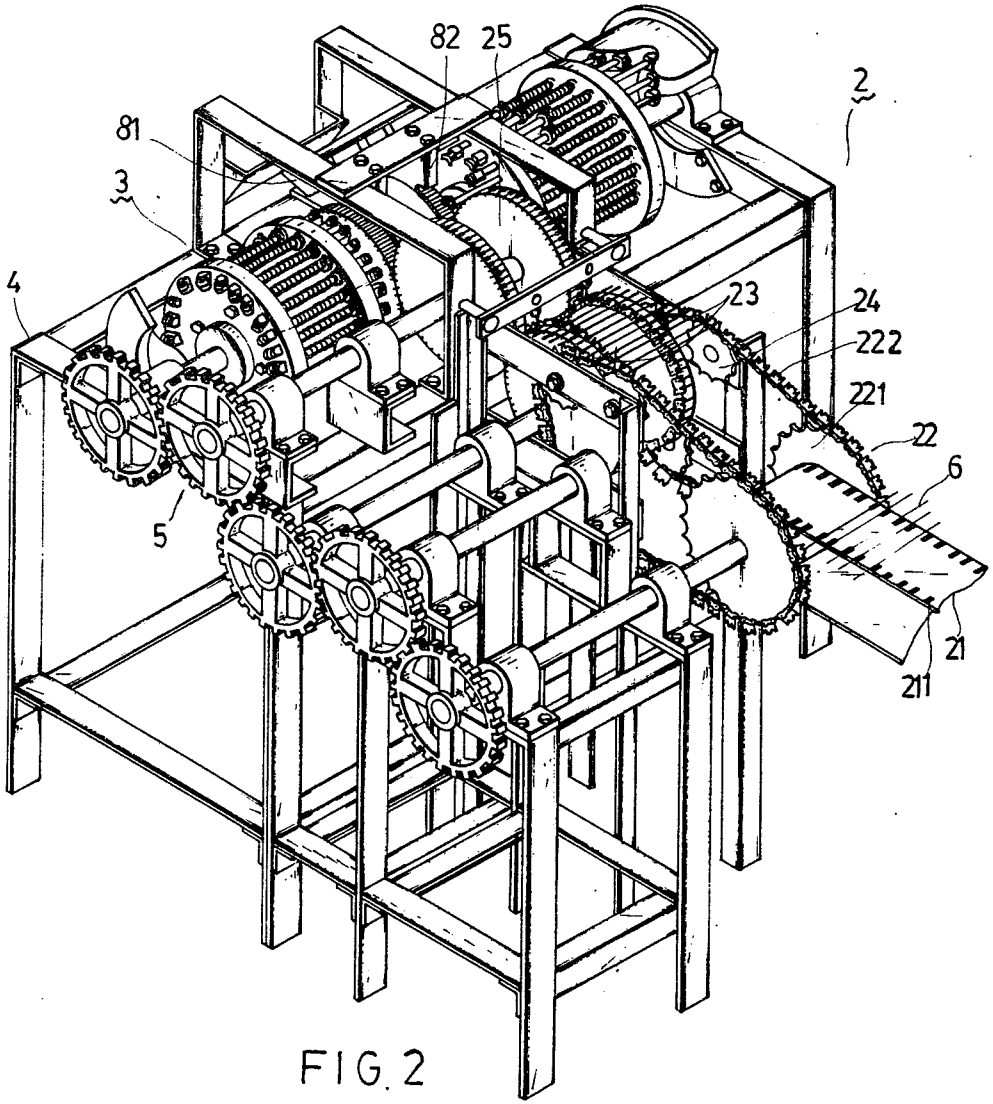
FIG. 2 is a perspective view of a wire feeding unit in combination with a wire forming unit.

In FIGS. 1 and 2 there is shown an apparatus for making paper clips which includes a wire cutting unit 1, a wire feeding unit 2, and a cut wire forming unit 3. As the cutting unit 1 is not within the scope of the invention the details thereof will not be described hereinunder.

As embodied herein, the cut wire feeding unit 2 and wire forming unit 3 are mounted on a frame 4 and are driven by a common drive mans through gear means 5. The feeding unit 2 includes a continuous belt 21 which is disposed downstream of the wire cutting unit 1. A plurality of magnets 211 are disposed at regularly spaced apart interval near two longitudinal sides of the belt 21 for attracting and arraying the cut wires in an orientation in which the cut wires are parallelly lain crosswise the advancing path.

There is further provided two continuous chains 22 downstream of the belt 21, as shown in FIG. 2. The chains 22 are overlapping the belt 21 in such a manner that two sprockets 221 over which the chains 22 pass are mounted on the same axis as a pulley (not shown) of the continuous belt 21. A plurality of catching elements 222 with toothed edges are affixed to the chains 22 at properly spaced intervals corresponding to the orientation of the cut wires on the belt 21. The toothed edges of the catching elements 222, when moving adjacent to the two sides of the continuous belt 21, catch the two ends of each cut wire 6 and then advance them along the path of the chain 22.

Figure 3:
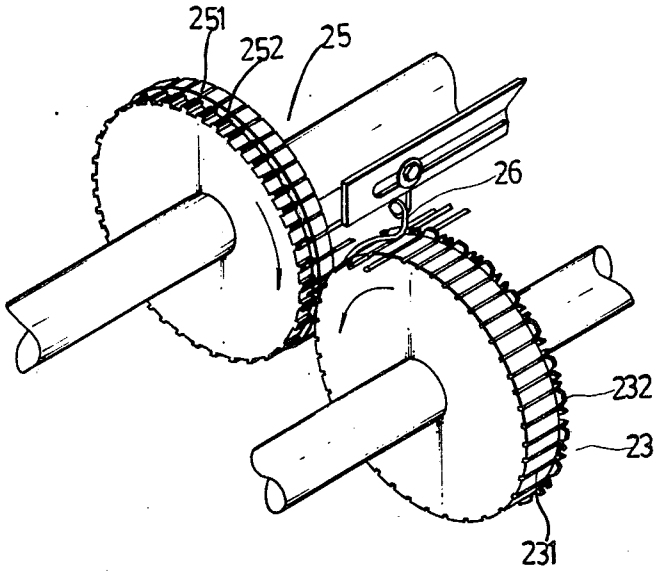
FIG. 3 is a perspective view illustrating the delivery of cut wires from the first wheel to the second wheel means.

As is shown in FIG. 2, there is further provided two wheels 23 which are mounted on the same axis as the other sprockets 221 of the chains 22. Each wheel 23 includes grooves 231 on the rim and teeth 232 at the edge thereof, as best shown in FIG. 3. Idler sprockets 24 are further provided for supporting the chains 22 so that there will be slightly raised chain paths near the wheels 23. When the toothed catching elements 222 pass over the idler sprockets 24, the cut wires carried thereby are caught by the teeth 232. The catching elements 222 leave the cut wires with the wheels 23 in the grooves 231 after they pass the idler wheels 24.

Referring again to FIG. 2 in conjunction with FIG. 3, there are further provided two wheels 25 which rotate in the opposite directions with respect to the wheels 23, with the rims thereof substantially in contact with those of the respective wheels 23. Each wheel 25 includes regularly spaced apart grooves 251 corresponding to the grooves 231 of the wheels 23, and each groove 251 is provided with a magnet 252 for attracting the cut wires 6 from the wheels 23 at the point of contacting of the wheels 23 and 25. However it should be appreciated that the wheels 25 can also take the cut wires 6 from the wheels 23 by attraction if the corresponding rims are in adjacent position. There is further provided a curved guide rod 26 which is affixed to the frame 4 and extended to approach a portion of the rim of the wheel 23 to press the cut wires which move adjacent to the wheels 25 to prevent them from the movement caused due to the attraction of the magnet 252. However when the cut wire reaches the point of contact of the wheels 23 and 25 it is relieved from the guidance of the guide rod 26 and attracted into the groove 251. The wheels 23 and 25 are rotating at opposite direction and the cut wires carried by the wheels 25 move in the clockwise direction to the wire forming unit 3 in a proper orientation corresponding to the cut wire receiving station of the forming unit 3.

Figures 4, 5:
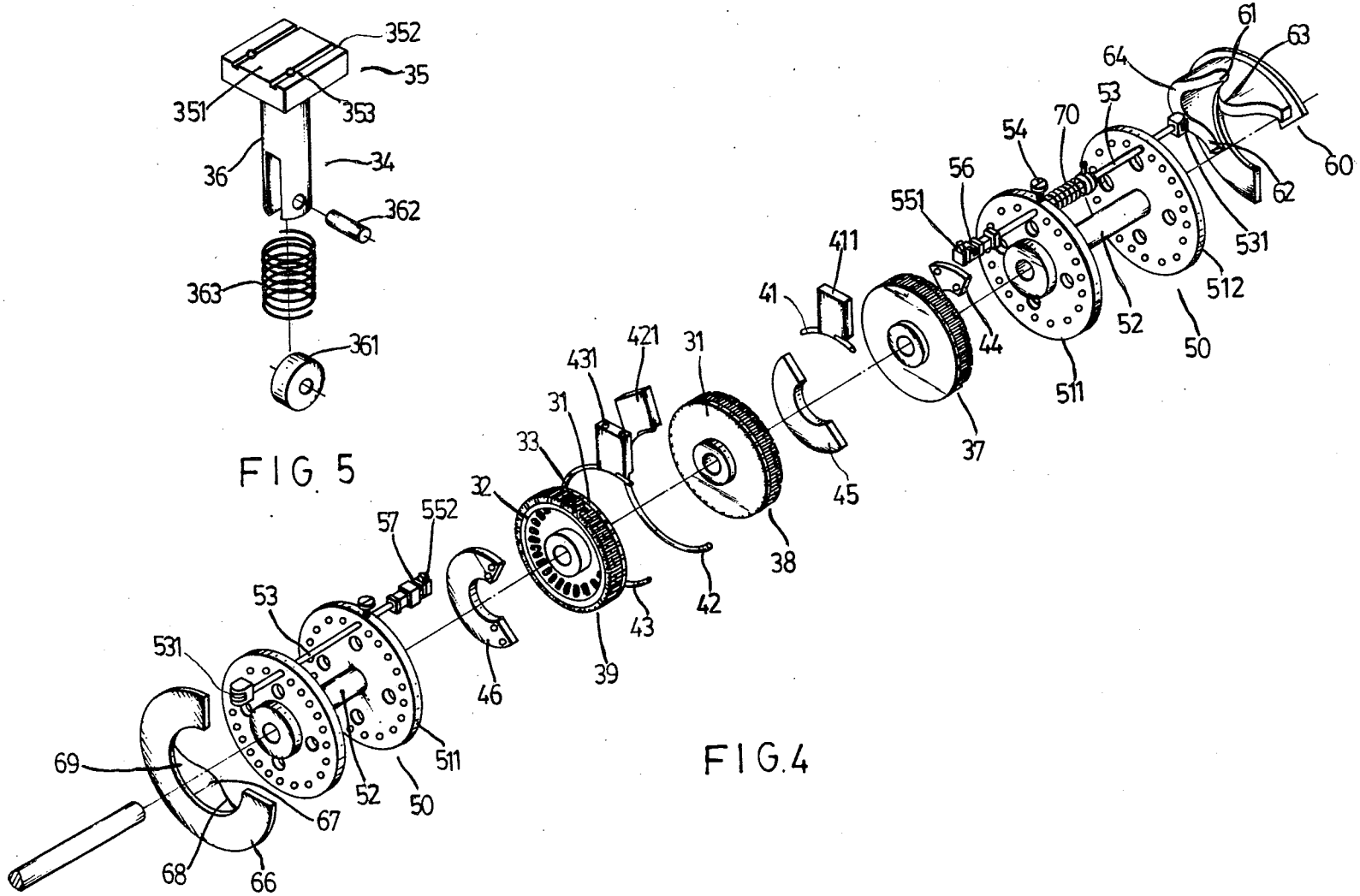
FIG. 4 is an exploded view of a wire forming device constructed according to the invention.
FIG. 5 is a perspective view of a die member constructed according to the invention.
Figure 6B:
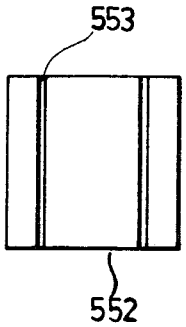
Figure 6A:
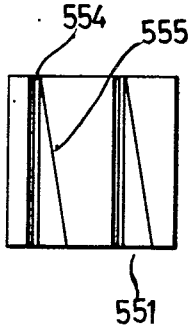

As embodied herein, the wire forming unit 3 includes three annular members 37, 38 and 39 as shown in FIG. 4. Each of the annular members has a circular plate 31 of which the edges are grooved covering one side thereof, the diameter of the circular plate 31 being greater than the diameter of the rim 32 of the annular member. At the rim 32 are provided regularly and properly spaced apart throughholes 33 for mounting forming die members 34 which are shown in FIG. 5. Each die member 34 includes a rectangular forming head portion 35 and a shank portion 36 adapted to be slidably inserted in the throughholes 33. At the bottom end of the shank portion 36 is pivoted a wheel member 361 by means of a pin 362. Between the pin 362 and the head portion 35, there is further provided a helical spring 363 which is sleeved onto the shank portion 36. The thickness of each forming head portion 35 is chosen such that it is equal to the difference between the radius of the rim 32 and circular plate 31. Therefore when the die member 34 is mounted on the rim 32 the surface 351 thereof is flush with the edge of the plate 31.

As embodied herein, each die member 34 mounted on each of the annular members 37, 38, 39 is in axial alignment with each die member 34 of the others. There are further provided two grooves 352 on the surface 351, each groove 352 being provided with a magnet 353. These grooves 352, in conjunction with the grooved edges of the circular plate 31 cooperatively form an array of grooves for receiving parallelly spaced apart wires 6. There are further provided three segmented ring members 41, 42 and 43 which are mounted on the frame 4 by means of bracket members 411, 421 and 431. The segmented ring members 411, 421 and 431 are of different lengths and are circumferentially disposed at the edges of the respective circular plates 31, with the clearances provided therebetween similar to the diameter of the cut wire 6.

As will be seen in FIG. 4 the annular members 37, 38, 39 further include three cam means 44, 45 and 46 therein which are in the form of segmented annular thick plates and mounted in fixed positions relative to the annular members 37, 38, 39. The three cam means 44, 45 and 46 are respectively similar to the three segmented ring members 41, 42 and 43 in the angular length and position thereof. The length of the cam means 44 starts from about 60° anticlockwise position and extends forward with an angular length of 80°. The length of the cam means 45 begins at the end of the cam means 44 and extends forward wit an angular length of 180° whereas the cam means 46 begins at the same position as the cam means 44 and extends forward with an angular length of 260°. During rotation of te annular members 37, 38, 39 the wheel means 361 of the die members 34 intermittently engages the edges of the cam means 44, 45 and 46 and the rectangular forming head portion 35 is intermittently raised from the peripheral surface of the annular members 37, 38, 39.

As embodied herein, the three annular members 37, 38, 39 rotate in the anticlockwise direction, opposite to the direction of the wheel means 25. The magnet elements 353 of the die members 34 attract the cut wires 6 from the wheel means 25 at the point of coinciding of the annular members 37, 39 and second wheel means 25. The grooves 352 receive the cut wires which lie across the three spaced apart annular members 37, 38, and 39 and carry them along the angular path thereof.

As shown in FIG. 4 there are further provided two ramming means 50 at the two sides of the three annular member assembly. Each ramming means 50 includes a rotary member rotating about the same axis as the annular member 37, 38, 39 and having two disc plates 511 and 512 fixedly connected to a shaft 52. A plurality of bars 53 annularly and movably mounted on the disc plates 511 and 512 in parallel positions relative to the shaft 52. Screws 54 are provided to penetrate the edge of each disc plate 511 and engage in axial grooves (not shown) which are provided in the bars 53 so that the bars 53 slide forward and backward without revolving action. At the end of each bar 53 is provided wheel means 531 which will rollingly and respectively engage with the edges of cylindrical cam means 60 and 66.

The cam means 60 has two descending edges 61 and 62 and two ascending edges 63 and 64, whereas the cam means 66 has an ascending edge 67 and two descending edges 68 and 69. When the wheel means 531 rolls on the ascending edges 63, 64 and 67 the bars 53 will move toward the die members 34. There are further provided spring members 70 respectively sleeved onto the bars 53 for biassing the bars 53 in the direction toward the cam means 60 and 66. Therefore reciprocating movements of the bars 52 are brought about by means of the cam means 60 and 66 and the spring members 70.

There are further provided rectangular die members 551 and 552 at the forwarding ends of the bars 52. Each die member 551 has two grooves 554 at the rectangular surface thereof and each die member 552 has two grooves 553 at the rectangular surface thereof as can be easily seem from FIG. *6a* and *6b*. The die members 551 and 552 are mounted on the bars 53 by means of spring loaded lock pins 56. At the top edges the die members 551 and 552 are further provided with sliding wheel means 57 which will provide downward pressure on the die members 53 when they come into contact with block members 81 and 82 affixed to the frame 4 as shown in FIG. 2, during reciprocating movements of the bars 53. The spring members (not shown) which load the lock pins 56 will provide elastic characteristic to return the die members 551 and 552 which are acted by the downward pressure.

The operation of wire forming device is illustrated in FIGS. *7a* through *7g*. As herein above described, the cut wires 6 are received in the grooves 352 of the die members 34 when they reach the wire forming station of the device. When a cut wire 6 enters the clearances between the segmented ring members 41, 42, 43 and the edges of the plates 31, the die members 34 begin to rise due to the cam means 44 and 46. At that time the cut wire 6 is acted on by the upward pressure of the die member 34 and downward pressure of the segmented ring members 41 and 43 and is therefore bent about the ring members 41 and 43 at 90°, as shown in FIG. *7a*.

The right side bent portion of the cut wire 6 is then pushed to bend to the left side by the bar 53 which engages the ascending edge 63 of the cam means 60. This situation is illustrated in FIG. *7b*. The cut wire 6 being pushed is guided in the groove 554 of the die member 551. At this time the sliding wheel 57 at the top of the die member 34 meets and is acted on by the block member 82, thereby providing the die member 551 a downward pressure which cause a slightly downward bending of the wire rod. The successive rotation of the rotary members 50 and the biasing action of the spring member 70 make the bar 53 continuously move along the edge of the cam means 60. The descending movement makes the bar depart from the die member 34 as shown in FIG. *7c*. At this moment the wire 6 begins to approach the cam means 45 and the rising of the die member 34 similarly produces a 90° bend of the wire 6 about the segmented ring member 42, as illustrated in FIG. *7d*. The bent portion is then acted on by the die member 551 which is pushed by the cam means 60, as shown in FIG. *7e*, to make a second bending about the segmented ring member 42. After this the left side bar 53 begins to bend the wire 6 toward the right as the wheel 531 engages and rolls on the ascending edge 67 of the cam 66. The clip formed is finally delivered from the die member 34 when it passes the ends of the segmented ring members 41 and 43 and the bar 53 leaves the die member 34.

As described above, it will be appreciated that the forming device produces a number of paper clips corresponding to the number of the die members 34 operative within one cycle.

With the invention thus explained, it is apparent that obvious modifications and variations can be made without departing from the scope of the invention. It is therefore intended that the invention be limited only as indicated in the appended claims.

What I claim is:

1. An apparatus used downstream of a wire cutting machine for feeding cut wires into a wire forming machine with parallelly and regularly spaced apart cut wires arrangement, comprising, continuous belt means for receiving and advancing cut wires provided with pieces of magnet at regular intervals for attracting and arraying cut wires, continuous chain means provided downstream of said belt means with one end of the conveying path thereof overlapping said belt means, said chain means including regularly spaced apart catching projections thereon for taking the cut wires from said belt means, first wheel means overlappingly provided downstream of said chain means and having regularly spaced catching teeth for catching cut wires and first grooves at the same spaced apart intervals as said catching teeth for receiving the cut wires, idler wheel means cooperative with said chain means to provide elevation in the path of said chain means to allow the cut wires to coincide with said catching teeth and grooves, said chain means leaving the cut wires with said first grooves after passing over said idler wheel, second wheel means, in contact with said first means, having second grooves at the same spaced apart intervals as said first grooves and a piece of second magnet in each said second groove, said first grooves and second grooves coinciding each other and said second magnet pieces attracting the cut wires from said first wheel at the points of coinciding, said second wheel means delivering the cut wires with a proper orientation of the cut wire in the wire forming device.

2. An apparatus for forming a paper clip from a cut piece of wire, comprising, three annular members spaced apart and mounted for rotation on the same axis, each of said annular members having a plurality of forming die members on the rim thereof for receiving cut wires, pieces of second magnet provided in each die member for attracting the cut wires, each of said die members of each said annular member being axially aligned with each of said die members of other said annular members for simultaneously engaging a cut wire, three segmented ring members of different lengths provided, in a fixed position relative to said annular member, along the circumferences of corresponding said annular members, with clearances provided therebetween similar to the diameter of the cut wire, ramming means provided at two sides of said annular member assembly adapted to exert bending forces on cut wires in the direction parallel to the axis of said annular member, said die members intermittently rising from the rim of said annular member to cooperate with said ramming means to bend the cut wires about said segmented ring members.

3. An apparatus as claimed in claim 2, wherein each of said die members has a shank portion adapted to be inserted into the rim of each of said annular member, each said annular member including cam means therein for engaging with the end of said shank portion to impart an intermittently raising movement.

4. An apparatus as claimed in claim 3, wherein said ramming means comprises, two rotary members each of which is provided at each side of said three annular member assembly and has a set of elongated elements annularly and movably mounted thereon in axial positions, said rotary member being coaxial with and rotatable at the same speed as said annular members, second cam means engaging one ends of the elongated elements, spring means for biassing the elongated elements against said cam means, cooperating with the cam means to provide reciprocating movements of said elongated elements, other ends of the elongated elements intermittantly extending over said die members for bending the cut wires.

5. An apparatus used for making paper clips downstream of a cutting machine, comprising, continuous belt means for receiving and advancing cut wires provided with pieces of magnet at regular intervals for attracting and arraying cut wires, continuous chain means provided downstream of said belt means with one end of the conveying path thereof overlapping said belt means, said chain means including regularly spaced apart catching projections thereon for taking the cut wires from said belt means, first wheel means overlappingly provided downstream of said chain means and having regularly spaced catching teeth and first grooves at the same spaced apart intervals as said catching teeth, idler wheel means cooperative with said chain means to provide elevation in the path of said chain means to allow the cut wires to coincide with said catching teeth and said first grooves, said chain means leaving the cut wires with said first grooves after passing over said idler wheel means, second wheel means in contact with said first means, having second grooves at the same spaced apart intervals as said first grooves and a piece of second magnet in each said second groove, said first and second grooves coinciding each other and said second magnet elements attracting the cut wires from said first wheel at the points of coinciding, said second wheel means feeding the cut wires with a proper orientation of the cut wires, three annular members which are spaced apart and mounted for rotation on the same axis provided downstream of said second wheel means, each of said annular members having a plurality of forming die member on the rim thereof for receiving cut wires from said second wheel means, each of said die member having magnet elements for attracting the cut wires, each of said die members of each said annular member being axially aligned with each of said die members of other said annular members for simultaneously receiving a cut wire, three segmented ring members of different lengths provided, in a fixed position relative to said annular member, along the circumferences of corresonding said annular members with clearances provided therebetween similar to the diameter of the cut wire, ramming means provided at two sides of said annular member assembly adapted to exert bending forces on cut wires in the direction parallel to the axis of said annular member, said die members intermittently rising from the rim of said annular member to cooperate with said ramming means to bend the cut wires about said segmented ring members.

* * * * *